United States Patent [19]

McClaflin

[11] 4,239,052

[45] Dec. 16, 1980

[54] METHOD OF TRANSPORTING VISCOUS HYDROCARBONS

[75] Inventor: Gifford G. McClaflin, Ponca City, Okla.

[73] Assignee: Conoco, Inc., Ponca City, Okla.

[21] Appl. No.: 13,357

[22] Filed: Feb. 21, 1979

[51] Int. Cl.[3] ..... F17D 1/17

[52] U.S. Cl. ..... 137/13; 252/8.55 R

[58] Field of Search ..... 252/8.55 R, 8.55 D, 252/8.3; 137/13; 406/47, 48, 49

[56] References Cited

U.S. PATENT DOCUMENTS

| | | | |
|---|---|---|---|
| 2,447,475 | 8/1948 | Kaberg et al. | 252/312 |
| 3,380,531 | 4/1968 | McAuliffe et al. | 166/314 |
| 3,467,195 | 9/1969 | McAuliffe et al. | 252/8.55 X |
| 3,491,835 | 1/1970 | Gagle | 137/13 X |
| 3,811,505 | 5/1974 | Flournoy et al. | 252/8.55 X |
| 3,943,954 | 3/1976 | Flournoy et al. | 137/13 |
| 4,099,537 | 7/1978 | Kalfoglou et al. | 137/13 |
| 4,108,193 | 8/1978 | Flournoy et al. | 252/8.55 X |

*Primary Examiner*—Herbert B. Guynn

*Attorney, Agent, or Firm*—Bayless E. Rutherford, Jr.

[57] ABSTRACT

An improvement in the method of transporting viscous hydrocarbons through pipes is disclosed. Briefly, the improvement comprises adding water containing an effective amount of a combination of an ethoxylated alkyl phenol and a low molecular weight alkaryl sulfonate. The resulting emulsion has a lower viscosity and is more easily transported.

11 Claims, No Drawings

METHOD OF TRANSPORTING VISCOUS HYDROCARBONS

BACKGROUND OF THE INVENTION

1. Field of the Invention

The invention is in the general field of improved methods of pumping viscous hydrocarbons through a pipe, such as well-bore or a pipeline.

2. General Background

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

Still another method of moving heavy crudes through pipes uses oil-in-water emulsions which use surfactants to form emulsions.

U.S. Pat. No. 3,943,954 teaches lowering the viscosity of a viscous hydrocarbon by adding an aqueous solution containing an anionic surfactant, such as sodium tridecyl sulfate, together with a guanidine salt and optionally with an alkalinity agent and/or a nonionic surfactant such as a polyethoxylated alcohol.

I have found that use of an aqueous solution containing a combination of an ethoxylated alkyl phenol and a low molecular weight alkaryl sulfonate provides better viscosity reduction than use of either material alone. Moreover, I have found that use of a guanidine salt is not necessary. I have obtained results equal to, or even better, when the combination of ethoxylated alkyl phenol and low molecular weight alkaryl sulfonate is used without the guanidine salt.

BRIEF SUMMARY OF THE INVENTION

Briefly stated, the present invention is directed to an improvement in the method of pumping a viscous hydrocarbon through a pipe wherein the improvement comprises forming an oil-in-waer emulsion by adding to said hydrocarbon from about 20 to about 80 volume percent water containing, as the only essential materials, an effective amount of a combination of an ethoxylated alkyl phenol and a water-soluble alkaryl sulfonate having a molecular weight below about 410 and preferably below about 350.

The specific nature of the ethoxylated alkyl phenol and water-soluble alkaryl sulfonate are provided in the detailed description.

DETAILED DESCRIPTION

Insofar as is known our method is suitable for use with any viscous crude oil. It is well known that crude oils often contain a minor amount of water.

The amount of water which is added to the hydrocarbon is suitably in the range of about 20 to about 80 volume percent based on the hydrocarbn. A preferred amount of water is in the range of about 30 to 60 volume percent. The water can be pure or can have a relatively high amount of dissolved solids. Any water normally found in the proximity of a producing oil-well is suitable.

Suitable ethoxylated alkyl phenols are mono- or dialkyls, wherein each alkyl group contains from about 6 to about 15 carbon atoms, and which contain from about 25 to about 75 ethoxy groups, preferably from about 30 to about 70 ethoxy groups. The preferred ethoxylated alkyl phenol is a monooctyl phenol.

Suitable water-soluble alkaryl sulfonates have a molecular weight below about 410 and are represented by the formula $$R_{(n)}Ar—SO_3M$$

wherein Ar is an aromatic moiety which is phenyl, tolyl, xylyl or ethylphenyl, R is a linear or branched-chain alkyl group containing 4 to 16 carbon atoms, n is 1 or 2, but preferably is 1, the total number of carbon atoms in alkyl groups is in the range of 8 to 16, and M is sodium, potassium or ammonium.

More suitably, the water-soluble alkaryl sulfonates have a molecular weight below about 375, preferably below about 350.

The more suitable and preferred alkaryl sulfonates are represented by the formula

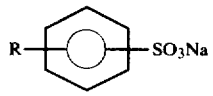

wherein R is an alkyl group containing 8 to 16, more suitably 9 to 14, and preferably 10 to 13, carbon atoms. The alkylbenzene sulfonates usually are mixtures containing alkyl groups in the carbon range specified.

Suitable and preferred amounts of the ethoxylated alkyl phenol and alkaryl sulfonate, based on the hydrocarbon, are shown below.

| | Suitable | Preferred |
|---|---|---|
| | (parts per million) | |
| Ethoxylated alkyl phenol | 50–10,000 | 100–1,000 |
| Alkaryl sulfonate | 50–10,000 | 100–1,000 |

Suitable ethoxylated octyl phenols are available from Rohm and Haas Company, under the tradename "TRITON", for example, TRITON X-305, containing 30 moles of ethylene oxide, and TRITON X-705, containing 70 moles of ethylene oxide.

My invention is restricted to the use of the combination of ethoxylated alkyl phenol and water-soluble alkaryl sulfonate to reduce the viscosity of viscous hydrocarbons when an aqueous solution containing the combination is added to the hydrocarbon.

Application Ser. No. 13,358, filed Feb. 21, 1979, wherein the inventors are Gifford G. McClaflin, Charles R. Clark and Thomas R. Sifferman, discloses and claims the reduction of viscosity of viscous hydrocarbons by forming an oil-in-water emulsion by adding to said hydrocarbon an aqueous solution cntaining an effective amount of a low molecular weight alkaryl sulfonate.

In order to illustrate the nature of the present invention still more clearly the following example will be given. It is to be understood, however, that the invention is not to be limited to the specific conditions or details set forth in these examples except insofar as such limitations are specified in the appended claims.

The following materials were used in the tests described herein:

Crude Oil—Goodwin lease crude from Cat Canyon oil field, Santa Maria, California Water—Goodwin synthetic (Water prepared in laboratory to simulate water produced at the well. It contained 4720 ppm total solids.)

The specific composition of the surfactant materials tested will be given in the examples.

Viscosities were determined using a Brookfield viscometer, Model LVT with No. 3 spindle. The procedure is described below.

TEST PROCEDURE

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60. Viscosity was calculated by using a multiphlication factor of 200, 100, 40 and 20 for the respective speeds times the dial reading on the viscometer.

It may be well to mention that the final result at 6 RPM is an indication of the stability of the solution being tested.

The difference in viscosity values on the crude alone in the example is due to the varying amount of water naturally present in the crude. For this reason the viscosity value of the crude alone was obtained in each example. The crude corresponded to that used in combination with the aqueous surfactant.

EXAMPLE 1

This example is comparative and shows the viscosity values obtained on the crude alone and a combination of 50 volume percent crude and 50 volume percent water which contained 500 ppm of a sodium monoalkylbenzene sulfonate having a molecular weight of about 334.

The results are shown in Table I.

TABLE I

| CRUDE OIL ALONE (300 ML) | | | CRUDE OIL PLUS 300 ML GOODWIN SYNTHETIC WATER CONTAINING 500 PPM OF THE DESCRIBED ALKYLBENZENE SULFONATE | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 28 | 5,600 | 1 | 9 | 200 | 1,800 |
| 12 | 57 | 5,700 | 1.5 | 8 | 150 | 800 |
| 30 | Offscale | — | 3 | 8 | 120 | 320 |
| 60 | Offscale | — | 6 | 12 | 120 | 240 |
| 30 | Offscale | — | 3 | 9 | 120 | 360 |
| 12 | 58 | 5,800 | 3 | 8.5 | 300 | 850 |
| 6 | 26.5 | 5,300 | 4 | 10 | 800 | 2,000 |
| Test Temperature 91° C. | | | 77° C.(1), 71° C.(2) | | | |

*Stirred a second time after taking readings for (1). Stopped stirrer and let stand two (2) minutes before taking rpm reading (viscosity measurement) for (2). This gives some measure of degree of emulsion stability. Emulsion contained lots of foam.

EXAMPLE 2

This example is comparative and shows the viscosity values obtained on the crude alone and a combination of 50 volume percent crude and 50 volume percent water which contained 500 ppm of an ethoxylated octyl phenol containing 70 moles of ethylene oxide per mole of octyl phenol.

The results are shown in Table II.

TABLE II

| CRUDE OIL ALONE (300 ML) | | | CRUDE OIL PLUS 300 ML GOODWIN SYNTHETIC WATER CONTAINING 500 PPM OF THE DESCRIBED ETHOXYLATED OCTYL PHENOL | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 18 | 3,600 | 0.5 | 12 | 100 | 2,400 |
| 12 | 38 | 3,800 | 1 | 18 | 100 | 1,800 |
| 30 | 93 | 3,720 | 1 | 32 | 40 | 1,280 |
| 60 | Offscale | — | 3 | 56 | 60 | 1,120 |
| 30 | 93 | 3,720 | 1.5 | 29 | 60 | 1,160 |
| 12 | 37 | 3,700 | 1.5 | 13 | 150 | 1,300 |
| 6 | 18 | 3,600 | 1.75 | 8 | 350 | 1,600 |
| Test Temperature 91° C. | | | 79° C.(1), 71° C.(2) | | | |

*Stirred a second time after taking readings for (1). Stopped stirrer and let stand two (2) minutes before taking rpm reading (viscosity measurement) for (2). This gives some measure of degree of emulsion stability. Emulsion contained very little foam.

EXAMPLE 3

This example is illustrative and shows the viscosity values obtained on the crude alone and a combination of 50 volume percent crude and 50 volume percent water which contained 250 ppm of the alkylbenzene sulfonate of Example 1 and 250 ppm of the ethoxylated octyl phenol of Example 2.

The results are shown in Table III.

TABLE III

| CRUDE OIL ALONE (300 ML) | | | CRUDE OIL PLUS 300 ML GOODWIN SYNTHETIC WATER CONTAINING 250 PPM OF THE ALKYLBENZENE SULFONATE AND 250 PPM OF THE ETHOXYLATED OCTYL PHENOL | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 14 | 2,800 | 0.5 | 0.5 | 100 | 100 |
| 12 | 30.5 | 3,050 | 0.75 | 0.5 | 75 | 50 |
| 30 | 76.5 | 3,060 | 1 | 0.5 | 40 | 20 |
| 60 | Offscale | — | 1 | 0.75 | 20 | 15 |
| 30 | 77.5 | 3,100 | 1 | 0.5 | 40 | 20 |
| 12 | 30.5 | 3,050 | 0.75 | 0.5 | 75 | 50 |
| 6 | 15.5 | 3,100 | 0.6 | 0.5 | 120 | 100 |
| Test Temperature 91° C. | | | 71° C. (1), 66° C. (2) | | | |

*Stirred a second time after taking readings for (1). Stopped stirrer and let stand two (2) minutes before taking rpm reading (viscosity measurement) for (2). This gives some measure of degree of emulsion stability. Emulsion contained very little foam.

EXAMPLE 4

This example is comparative and shows the viscosity values obtained on the crude alone and a combination of 50 volume percent crude and 50 volume percent water which contained 500 ppm of an ethoxylated octyl phenol containing 30 moles of ethylene oxide per mole of octyl phenol.

The results are shown in Table IV.

TABLE IV

| CRUDE OIL ALONE (300 ML) | | | CRUDE OIL PLUS 300 ML GOODWIN SYNTHETIC WATER CONTAINING 500 PPM OF THE DESCRIBED ETHOXYLATED OCTYL PHENOL | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 12.5 | 2,500 | 1.2 | 7.5 | 240 | 1,500 |
| 12 | 25 | 2,500 | 1 | 8 | 100 | 800 |
| 30 | 61 | 2,440 | 1.5 | 4 | 60 | 160 |
| 60 | Offscale | — | 3 | 4 | 60 | 80 |
| 30 | 61 | 2,440 | 2 | 3 | 80 | 120 |
| 12 | 25 | 2,500 | 2 | 2 | 200 | 200 |
| 6 | 12 | 2,400 | 2 | 2 | 400 | 400 |
| Test Temperature 91° C. | | | 74° C.(1), 66° C.(2) | | | |

*Stirred a second time after taking readings for (1). Stopped stirrer and let stand two (2) minutes before taking rpm reading (viscosity measurement) for (2). This gives some measure of degree of emulsion stability. Emulsion contained very little foam.

EXAMPLE 5

This example is illustrative and shows the viscosity values obtained on the crude alone and a combination of 50 volume percent crude and 50 volume percent water which contained 250 ppm of the alkylbenzene sulfonate of Example 1 and 250 ppm of the ethoxylated octyl phenol of Example 4.

The results are shown in Table V.

TABLE V

| CRUDE OIL ALONE (300 ML) | | | CRUDE OIL PLUS 300 ML GOODWIN SYNTHETIC WATER CONTAINING 250 PPM OF THE ALKYLBENZENE SULFONATE AND 250 PPM OF THE ETHOXYLATED OCTYL PHENOL | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 10.5 | 2,100 | 0.5 | 0.75 | 100 | 150 |
| 12 | 21 | 2,100 | 0.5 | 0.6 | 50 | 60 |
| 30 | 53 | 2,120 | 0.75 | 0.6 | 30 | 24 |
| 60 | Offscale | — | 1 | 0.6 | 20 | 12 |
| 30 | 54 | 2,160 | 1 | 0.6 | 40 | 24 |
| 12 | 21 | 2,100 | 0.5 | 0.25 | 50 | 25 |
| 6 | 10.5 | 2,100 | 0.5 | 0.20 | 100 | 40 |
| Test Temperature 91° C. | | | 77° C.(1), 71° c.(2) | | | |

*Stirred a second time after taking readings for (1). Stopped stirrer and let stand two (2) minutes before taking rpm reading (viscosity measurement) for (2). This gives some measure of degree of emulsion stability. Emulsion contained very little foam.

EXAMPLE 6

This example illustrates the effect of guanidine hydrochloride in the viscosity-reducing compositions.

Viscosity values were obtained on the following compositions:

(A)

300 ml Goodwin crude oil
300 ml synthetic water containing
250 ppm alkylbenzene sulfonate of Example 1
250 ppm ethoxylated alkyl phenol of Example 2
1,000 ppm of guanidine hydrochloride (B)

300 ml Goodwin crude oil
300 ml synthetic water containing
250 ppm alkylbenzene sulfonate of Example 1
250 ppm ethoxylated alkyl phenol of Example 2

The results are shown in Table VI-A and VI-B.

TABLE VI-A

| Composition With Guanidine Hydrochloride | | | | |
|---|---|---|---|---|
| RPM | Dial Reading | Viscosity cp | Dial Reading* | Viscosity* cp |
| 6 | 0.3 | 15 | 0.7 | 35 |
| 12 | 0.3 | 7.5 | 0.6 | 15 |
| 30 | 1.4 | 14 | 1.5 | 15 |
| 60 | 2.7 | 13.5 | 3.3 | 16.5 |
| 30 | 1.3 | 13 | 1.7 | 17 |
| 12 | 0.7 | 17.5 | 0.3 | 7.5 |
| 6 | 0.5 | 25 | 0.3 | 15 |
| Test Temperature 72° C. | | | Test Temperature 69° C. | |

*Stopped stirrer and let stand two minutes before taking reading.

TABLE VI-B

| Composition Without Guanidine Hydrochloride | | | | | | |
|---|---|---|---|---|---|---|
| RPM | Dial Reading | Viscosity cp | Dial Reading | Viscosity cp | Dial* Reading | Viscosity* cp |
| 6 | 0.3 | 15 | 0.7 | 35 | 0.3 | 15 |
| 12 | 0.6 | 15 | 0.7 | 17.5 | 0.2 | 5 |
| 30 | 1.0 | 10 | 1.2 | 12 | 0.9 | 9 |
| 60 | 2.5 | 12.5 | 2.7 | 13.5 | 2.7 | 13.5 |
| 30 | 1.0 | 10 | 1.3 | 13 | 1.2 | 12 |
| 12 | 0.5 | 12.5 | 0.4 | 10 | 0.5 | 12.5 |
| 6 | 0.2 | 10 | 0.5 | 25 | 0.3 | 15 |
| Test Temp 74° C. | | | Test Temp 70° C. | | Test Temp 66° C. | |

*Stopped stirrer and let stand two minutes before taking reading.

Tests were run using an aqueous solution containing 250 ppm ethoxylated octyl phenol and 250 ppm of an alkylbenzene sulfonate having a molecular weight of in the range of 415 to 430. The tests indicated that the combination containing the high molecular weight sulfonate was not effective in reducing the viscosity of the crude oil.

Thus, having described the invention in detail, it will be understood by those skilled in the art that certain variations and modifications may be made without departing from the spirit and scope of the invention as defined herein and in the appended claims.

I claim:

1. In the method of pumping a viscous hydrocarbon through a pipe the improvement which comprises forming an oil-in-water emulsion by adding to said hydrocarbon from about 20 to about 80 volume percent of an aqueous solution containing, as the only essential materials, an effective amount, based on said hydrocarbon, of a combination of about 50 to about 10,000 parts per million of an ethoxylated alkyl phenol and about 50 to about 10,000 parts per million of a water-soluble alkaryl sulfonate, said ethoxylated alkyl phenol being selected from the group consisting of monoalkyl phenols and dialkyl phenols, wherein the alkyl group contains from about 6 to about 15 carbon atoms, and which contains from about 25 to about 75 ethoxy groups and said water-soluble alkaryl sulfonate has a molecular weight below about 410 and is represented by the formula $$R_{(n)}Ar—SO_3M$$

wherein Ar is an aromatic moiety which is phenyl, tolyl, xylyl, or ethylphenyl, R is a linear or branched alkyl group containing 4 to 16 carbon atoms, n is an integer of 1 or 2, M is sodium, potassium, or ammonium, and the total number of carbon atoms in the alkyl groups is in the range of 8 to 16.

2. The method of claim 1 wherein the ethoxylated phenol is a monoalkyl phenol.

3. The method of claim 2 wherein the alkaryl sulfonate has a molecular weight below about 375 and is represented by the formula

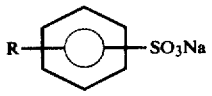

wherein R is an alkyl group containing from about 9 to about 14 carbon atoms.

4. The method of claim 3 wherein the ethoxylated phenol is a monooctyl phenol containing about 30 to about 70 moles of ethylene oxide per mole of monooctyl phenol.

5. The method of claim 4 wherein said hydrocarbon is a crude oil.

6. The method of claim 1 wherein the amount of aqueous solution added to said hydrocarbon is in the range of about 30 to about 60 volume percent, base on said hydrocarbon.

7. The method of claim 6 wherein the aqueous solution contains, based on said hydrocarbon, a combination of about 100 to about 1,000 parts per million of an ethoxylated alkyl phenol and about 100 to about 1,000 parts per million of a water-soluble alkaryl sulfonate.

8. The method of claim 7 wherein the alkaryl sulfonate has a molecular weight below about 375 and is represented by the formula

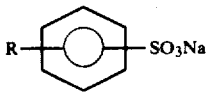

wherein R is an alkyl group containing from about 9 to about 14 carbon atoms.

9. The method of claim 8 wherein the ethoxylated phenol is a monooctyl phenol containing about 30 to about 70 moles of ethylene oxide per mole of monooctyl phenol.

10. The method of claim 9 wherein the alkyl group of said alkaryl sufonate contains about 10 to about 13 carbon atoms.

11. The method of claim 10 wherein said hydrocarbon is a crude oil.

* * * * *